United States Patent [19]

Gschwender

[11] Patent Number: 4,530,641

[45] Date of Patent: Jul. 23, 1985

[54] PUMP, PARTICULARLY A SUBMERSIBLE OR BARREL PUMP

[75] Inventor: Alois Gschwender, Neubulach, Fed. Rep. of Germany

[73] Assignee: Flux-Geraete Gesellschaft Mit Beschraenkter Haftung, Stuttgart, Fed. Rep. of Germany

[21] Appl. No.: 485,540

[22] Filed: Apr. 15, 1983

[30] Foreign Application Priority Data

Apr. 17, 1982 [DE] Fed. Rep. of Germany ..... 3214185

[51] Int. Cl.[3] ..... F01D 25/00

[52] U.S. Cl. ..... 415/170 R; 415/169 R; 415/501

[58] Field of Search ..... 415/122 R, 142, 168, 415/169 R, 169 A, 501, 219 R, DIG. 3, 108, 110; 417/424

[56] References Cited

U.S. PATENT DOCUMENTS

| | | | |
|---|---|---|---|
| 1,141,010 | 5/1915 | Scheurmann | 415/501 |
| 1,170,512 | 2/1916 | Chapman | 415/501 |
| 1,170,574 | 2/1916 | Sperry | 415/501 |
| 1,266,552 | 5/1918 | Chapman | 415/501 |
| 1,677,262 | 7/1928 | Wintroath | 415/169 |
| 2,764,943 | 10/1956 | Peters | 417/424 |

*Primary Examiner*—Robert E. Garrett
*Assistant Examiner*—John Kwon
*Attorney, Agent, or Firm*—Schwartz, Jeffery, Schwaab, Mack, Blumenthal & Evans

[57] ABSTRACT

The pump has a drive shaft which is supported in a support housing by at least an upper bearing and a lower bearing. One end of the drive shaft is connected to a rotor disposed in a rotor chamber which borders the lower bearing and from which at least one lifting duct runs parallel to the support housing in the direction of the drive unit and an outlet for the pumped fluid. The free cross section of the support housing above the lower bearing is extended by at least one clearance gap which projects into the lifting duct and which is blocked off against the flow of liquid in the lifting duct.

16 Claims, 14 Drawing Figures

PUMP, PARTICULARLY A SUBMERSIBLE OR BARREL PUMP

BACKGROUND OF THE INVENTION

1. Field of the Invention

The present invention relates to pumps, and particularly to submersible or barrel pumps which have a drive shaft mounted in a support housing connected at one end to a drive unit and at the other end to a rotor disposed in a rotor chamber which borders a lower bearing of the drive shaft and from which at least one lifting duct runs parallel to the support housing in the direction of the drive unit and an outlet for the pumped fluid.

2. Discussion of Related Art

In known submersible pumps the drive shaft is held in a coaxial support housing which is surrounded by an annular lifting duct. While liquid is being pumped, it is possible for some of the liquid to penetrate into the support housing past the lower shaft bearing. Thus, particularly in the case of high-speed pumps, there is the danger that the fluid will rise in the support housing as far as the drive unit or be thrown upwards and penetrate into the drive unit. Particularly in the case of aggressive fluids, this can lead to operational troubles and to the complete failure of the pump.

A known method of obviating this disadvantage is for the fluid which has penetrated into the support tube to be drained via a leakage opening which is situated at the upper end of the support housing. This method has, however, proved to be inadequate since, when the pump is stationary, the liquid in the support housing rises up to about the level of the liquid surrounding the pump and, when the pump starts up, the pressure suddenly becomes so great that the liquid in the support housing is flung up to the drive unit as if by an eruption.

A further disadvantage is that when the pump is lifted out of the fluid being pumped, the liquid in the support housing cannot drain without hindrance. Thus, when the pump has been removed, the liquid continues to drip out of the support housing for a lengthy period of time, which can lead to fouling and, particularly in the case of acids, to severe burning.

SUMMARY OF THE PRESENT INVENTION

One object of the present invention is to provide a submersible or barrel pump in which it is impossible for liquid being pumped to rise to and contaminate the drive unit.

Another object of the present invention is to provide a submersible or barrel pump having a housing which can be drained completely and quickly after the pump has been lifted out of the fluid being pumped.

An even further object of the present invention is to provide a submersible or barrel pump which is relatively easy to construct, yet is highly durable and effective in use.

In accordance with the above and other objects, the present invention is a pump comprising an elongated support housing and an elongated drive shaft, having an upper end and a lower end, mounted in the support housing by at least one lower bearing and one upper bearing. A drive unit is mounted to the upper end of the drive shaft for rotating the drive shaft. A rotor is mounted to the lower end of the drive shaft, and a rotor chamber is disposed around the rotor. The rotor chamber has an upper portion bordering the lower bearing. At least one lifting duct having a lower end with an inlet in the rotor chamber extends along the support housing in the direction of the drive shaft and has an upper end with an outlet.

A clearance gap may be formed in the support housing extending into the lifting duct. Walls separate the clearance gap from a flow of liquid in said lifting duct. Also, an outlet passage may connect the clearance gap with space surrounding the pump to discharge liquid in the clearance gap.

BRIEF DESCRIPTION OF THE DRAWINGS

The above and other objects of the present invention will become more readily apparent in connection with the detailed description below, reference being had to the accompanying drawings in which like reference numerals represent like parts throughout, and in which.

DETAILED DESCRIPTION OF THE PREFERRED EMBODIMENTS

Figure 1:
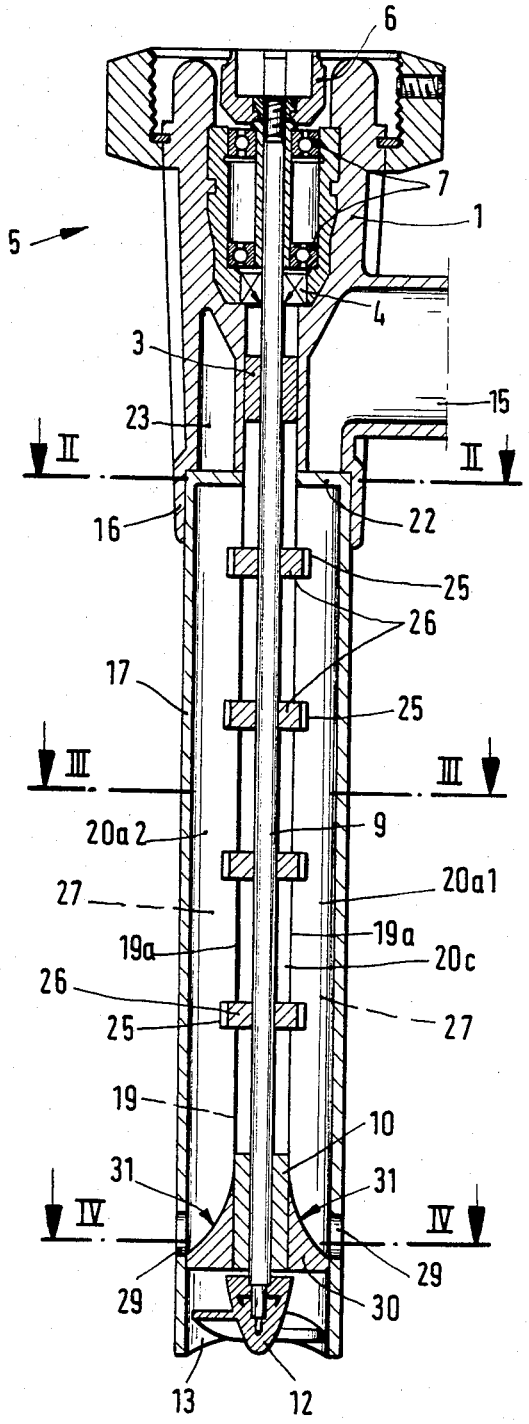
FIG. 1 shows an axial section through a barrel pump.

The barrel pump shown in FIG. 1 is, as is customary, submerged from above into the liquid to be pumped. It has a drive unit 5 with a housing 1 in which a drive shaft 9 is held in its upper region by means of two ball bearings 7 and a sleeve bearing 3. Mounted at the upper end of the drive shaft 9 is a coupling piece 6 which is used for connection to the shaft of a drive motor (not shown). The drive motor may, for example, be an electric motor. The sleeve bearing 3 additionally acts to restrict vapors and gases which rise from the fluid being pumped. This largely protects the ball bearings 7 against corrosion and similar damage which might be caused by such gaseous fluids. The shaft 9 is additionally sealed from the lower ball bearing 7 by a lip seal 4 which is disposed in the lower through-opening of the bearing housing.

Figure 2:
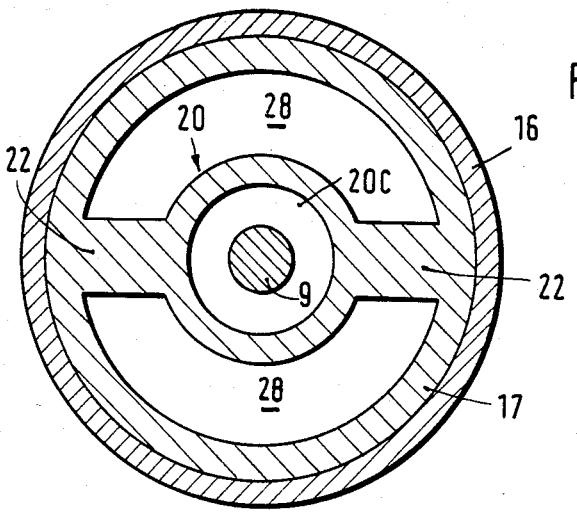
FIG. 2 shows a cross section on line II—II in FIG. 1.
Figure 3:
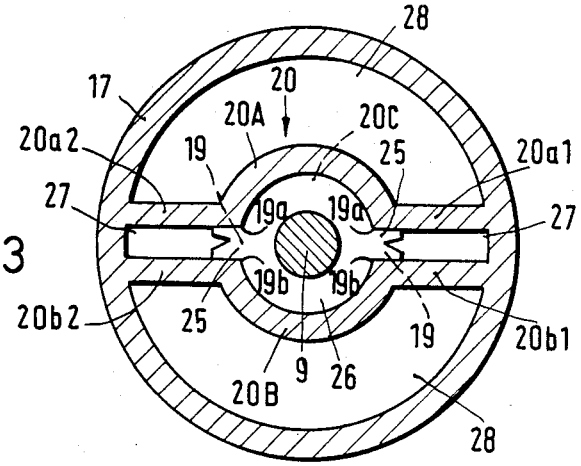
FIG. 3 shows a cross section on line III—III in FIG. 1.
Figure 4:
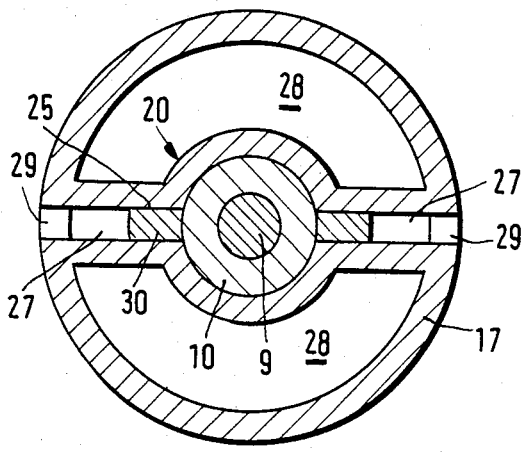
FIG. 4 shows a cross section on line IV—IV in FIG. 1.

The drive shaft 9 is surrounded by a lifting pipe set which contains a lifting pipe 17 and a tubular support housing 20. Pipe 17 and housing 20 are coaxial with the shaft 9 and, in the example shown, are made together in an integral tube section. The support housing 20 consists basically of two partially cylindrical half-shells 20A and 20B which each contain two lateral flanges **20*a*1 and 20*a*2/20*b*1 and 20*b*2 which extend axially in the lifting pipe 17 (FIGS. 1, 3 and 4). The half-shells 20A and 20B border an annular gap 20C which surrounds the drive shaft 9, and the opposed flanges 20*a*1 and 20*b*1/20*a*2 and 20*b*2 each form, together with the bordering wall of the lifting pipe 17, one of two clearance gaps 27 which are diametrically opposed (FIG. 3). Viewed from the annular gap 20C, the neighboring inside edges 19*a* and 19*b* of the support housing 20 each border an axial slit 19 which penetrates the inner wall of the support housing 20 and forms the transition from the annular gap 20C into the respective clearance gap 27. The two clearance gaps 27 are each closed at the upper end of the support housing by a cover wall 22 which connects the two flanges 20*a*1 and 20*b*1/20*a*2 and 20*b*2 (FIGS. 1 and 2). The lifting pipe 17 projects beyond the lower end of the support housing 20 and forms a rotor chamber 13 in which there is a rotatable rotor 12 which is mounted on the lower end of the drive shaft 9. Above the rotor 12 the shaft 9 is supported by a guide bearing 10 which is disposed in the annular gap 20C of the support housing 20. In the embodiment shown, the drive shaft 9 is made of solid material. It is supported over its length in the middle region by four support bearings 26 which are disposed in the annular gap 20C of the support housing at axial intervals and which each have two clamping shoulders 25 by means of which they are inserted into the two clearance gaps 27. The support bearings 26 are, therefore, held positively (form-fit) in the radial direction by means of their clamping shoulders 25** and non-positively (friction) in the axial direction.

The tube section (FIG. 5) consisting of the lifting pipe 17 and the support housing 20 may be made by injection molding a chemically resistant plastic. It may also be made from metal, e.g. high-grade steel or aluminum and can be drawn.

In the embodiment shown, the clearance gaps 27 as well as the respective axial slits 19 extend over the entire length of the support housing 20. In certain applications it may be advantageous to provide each axial slit with a radially adjoining clearance gap only over a partial length of the support housing 20 so that the clearance gap 27 begins immediately above the rotor chamber 13.

The two parts 20A and 20B of the support housing form, with their flanges and the jacket of the lifting pipe 17, two separate lifting ducts 28 which join into a common collection chamber 23 of the housing 1 to which there is an outlet 15. The lifting pipe 17 is fitted pressure-tight in a connection fitting 16 of the housing 1. It may be bonded, welded or soldered into the fitting 16. A screwed connection using a gasket is also possible.

The clearance gaps 27 are closed off pressure-tight from the collection chamber 23 by their cover walls 22. At the opposite end of the support pipe a common plug 30 is inserted into the clearance gaps 27 to seal them off. The plug 30 also serves to hold the guide bearing 10. The lower ends of the clearance gaps 27 each have an opening 29 in the lifting pipe 17. Openings 29 provide a connection path to the outside. At the bottom the clearance gaps 27 are closed off by the surface 31 of the plug 30. Each surface 31 rises progressively from the lower edge of an opening 29 to the support housing 20, preferably in a 90° arc segment so that there are no edges or crevices in which dirt particles from the liquid can get caught. Furthermore, the surface 31 of the plug 30 forms a deflection surface with only a slight flow resistance for the liquid which flows axially from top to bottom and is deflected radially through an opening 29. The outlet openings 29 may also have a greater axial length, for example they may extend from the plug 30 over almost the entire axial length of the clearance gap 27 to the top.

When the barrel pump is in operation the fluid is pumped from the pipe into the lifting ducts 28 so that it enters the collection chamber 23 and from there the outlet 15. From the rotor chamber 13, liquid can get between the shaft 9 and the guide bearing 10. This provides a lubricating effect which may well be desired. However, the fluid should not rise in the annular gap 20C between the shaft 9 and the support housing under pressure to the drive unit 5. Owing to the fact that the volume of the annular gap 20C has been increased by the clearance gaps 27, the pressure drops off immediately after the fluid has passed the guide bearing 10. The lubricating film which has formed on the shaft is maintained without the penetrated fluid rising too far or being thrown upwards. The fluid which is entrained by the rotating drive shaft 9 in the circumferential direction is skimmed off at the edges **19*a* and 19*b* of the axial slits 19 and can drain downwards in the clearance gaps 27. The fact that the openings 29 are disposed at the axially bottom-most point of the clearance gaps 27 guarantees that when the barrel pump is lifted out of the fluid being pumped, the remaining liquid present in the support housing 20** can drain quickly without hindrance so that, particularly in the case of aggressive fluids, burns can be prevented through the subsequent dripping of acid out of the support housing of the barrel pump.

Figure 5:
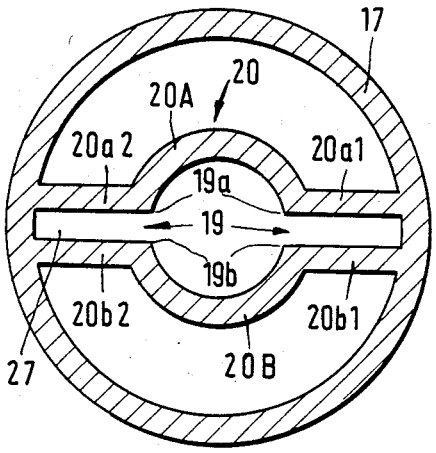
FIG. 5 shows a cross section along line III—III in FIG. 1 showing only the lifting pipe and the support housing.
Figure 6:
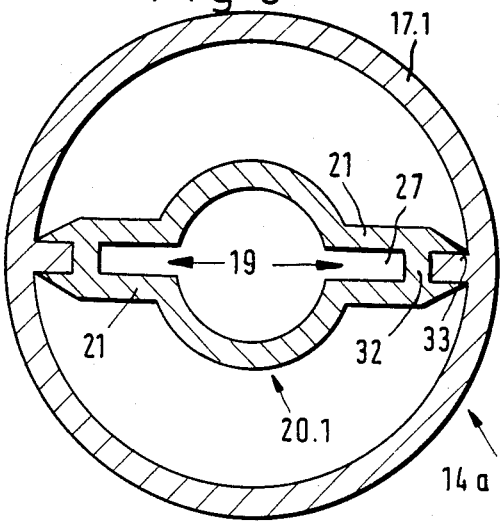
FIG. 6 shows a different embodiment of the lifting pipe with support housing in a section corresponding to FIG. 5.
Figure 7:
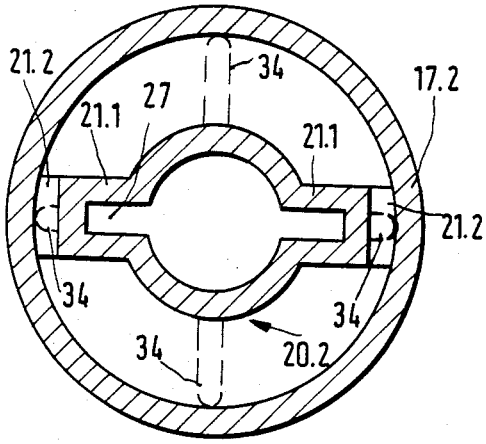
FIG. 7 shows a further embodiment of the lifting pipe with support housing in a section corresponding to FIG. 5.
Figure 8:
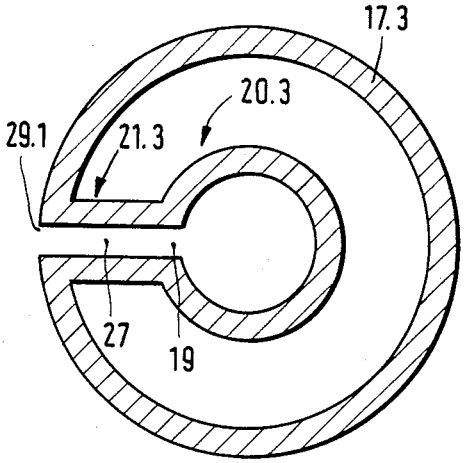
FIG. 8 shows a further embodiment of the lifting pipe with support housing in a section corresponding to FIG. 5.
Figure 9:
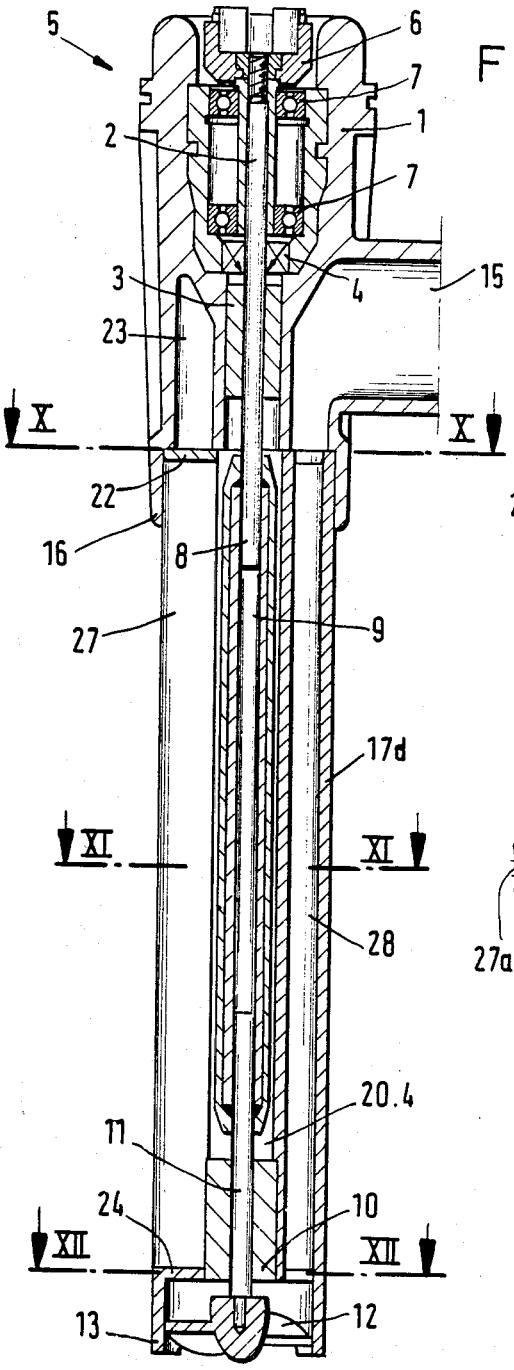
FIG. 9 shows an axial section through a different embodiment of barrel pump in which there are three lifting ducts.
Figure 10:
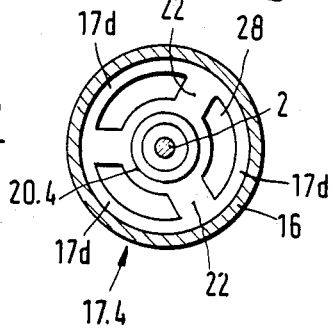
FIG. 10 shows a section on X—X in FIG. 9.
Figure 11:
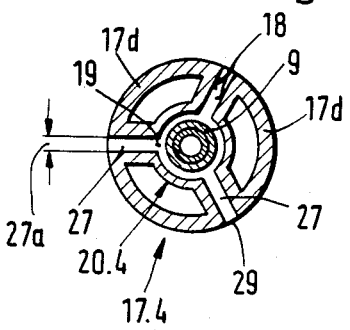
FIG. 11 shows a section on XI—XI in FIG. 9.
Figure 12:
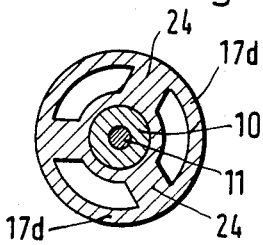
FIG. 12 shows a section on XII—XII in FIG. 9.

FIGS. 6, 7 and 8 show various embodiments of the lifting pipe with support housing in cross section according to FIG. 5.

According to FIG. 6 the support housing 20.1 which is in the form of a tube section is inserted in the lifting pipe 17.1. The support housing 20.1 includes two lateral flanges 21. The flanges have a hollow profile which is closed on three sides and thus form the two clearance gaps 27. Provided at their radially outer ends are axial grooves 32 which extend over the entire length of the support housing 20.1. The lifting pipe 17.1 has diametrically opposed, appropriately shaped inner radial webs 33 which positively engage (form-fit) the axial grooves 32 so that the tube section is held positively and accurately centered in the lifting pipe 17.1. In this embodiment it is possible for the lifting pipe 17.1 to be made from a different material than the support housing 20.1. For example, lifting pipe 17.1 may be made from stainless steel or aluminum whereas the support housing 20.1 is preferably injection-molded from plastic. However, it is also possible for both parts to be made of plastic or of metal. In the area of the lower end of the support housing 20.1 each clearance gap 27 is connected to a radial opening in the lifting pipe 17.1 which, as in the embodiment of FIG. 1, connects the clearance gap 27 to the space surrounding the pump.

A further embodiment is shown in FIG. 7. The support housing 20.2, which is disposed in the cylindrical lifting pipe 17.2, likewise has two diametrically opposed clearance gaps 27 which are formed by flanges 21.1. Flanges 21.1 form hollow profiles closed on three sides. The support housing 20.2 is connected to the lifting pipe 17.2 only at its upper and at its lower end. At its lower end it may have radial shoulders 21.2 which adjoin the flanges 21.1 and which each contain a connecting channel between the clearance gap 27 and the radial outlet opening provided in the lifting pipe 17.2. This results in an outlet being formed as in the embodiment in FIG. 1.

Furthermore, the support housing 20.2 may be supported with radial webs 34 (broken line) in the lifting pipe 17.2. In the embodiment shown, there are four radial webs uniformly distributed over the circumference which can be produced in one piece with the support housing 20.2.

FIG. 8 shows a further embodiment of the support housing with only one clearance gap 27. The support housing 20.3 has an axial slit 19 which is adjoined by the clearance gap 27. The walls of the clearance gap 27 become the wall of the lifting pipe 17.3 so that the support housing 20.3 is held coaxial with the lifting pipe 17.3 merely by its flange 21.3 which forms the walls of the clearance gap 27. In this embodiment the opening 29.1 in the lifting pipe 17.3 runs parallel to the axial slit 19 in the support housing 20.3 so that the clearance gap 27 is basically open over its entire axial length towards the space surrounding the pump.

FIGS. 9 to 12 show a barrel pump which has three lifting ducts 28 and which largely corresponds to the embodiment in FIG. 1 in its upper and lower regions. The drive shaft 9 consists of a hollow shaft with two tubes inside each other and an upper journal 2 as well as a lower journal 11 which are welded to the inner tube 8 of the hollow shaft. The upper drive journal 2 is, like the shaft 9 in FIG. 1, held in the housing 1 of the drive unit 5 by two ball bearings 7 and one sleeve bearing 3. The rotor 12 is situated on the lower journal 11 which is supported by the guide bearing 10.

The lifting pipe 17.4 and the support housing 20.4 are formed by three hollow tubes **17*d*. These tubes 17*d* each contain a lifting duct 28 which is partially cylindrical in cross section and has a circumferential length of approximately 100°, as can be seen from FIGS. 10 to 12. The radially inner walls of the tubes 17*d* together form the cylindrical support housing 20.4 which coaxially surrounds the drive shaft with a slight clearance. The end faces 18 of the lifting pipes 17*d*, which are opposite each other in the circumferential direction, are separated by a gap 27*a* which corresponds to the width of the respective clearance gap 27. The three clearance gaps are open towards the pressureless space surrounding the pump over their entire axial length. Thus, in the circumferential direction a lifting pipe 17*d* is followed by a clearance gap 27** and so on.

The inlet opening of each clearance gap 27 is formed by an axial slit 19 which are formed by the arrangement of the lifting pipes **17*d* in the cylindrical interior of the support housing 20.4. The clearance gaps 27 are sealed off tightly against the flow of fluid by their cover walls 22 at the top and by a base 24 at the bottom. At the same time, the cover walls 22 and the base parts 24 rigidly connect the lifting pipes to each other, thus forming one structural unit. It may be of advantage to provide additional connecting webs between the lifting pipes 17*d*** which may be in the form of a segment and finish flush with the outer cylindrical surfaces of the lifting pipes. The lifting pipes may also be held together additionally by outer connecting elements or rings.

In this embodiment too, it is not possible for a pressure to be built up in the support housing either when the barrel pump starts up or when it is in operation.

Figure 13:
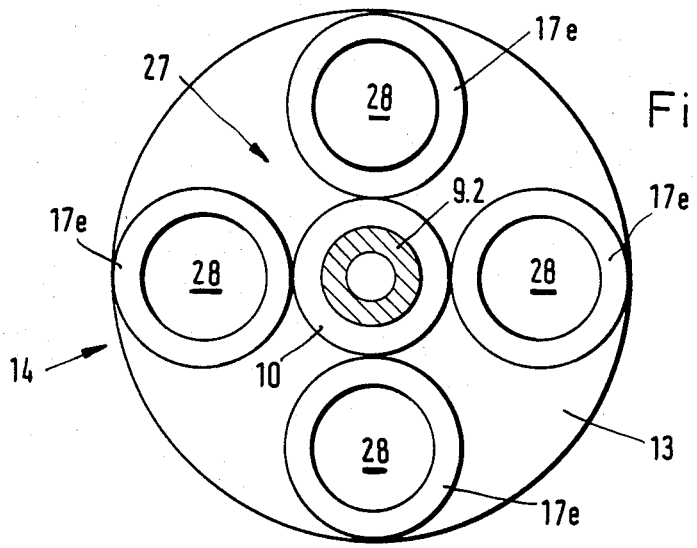
FIG. 13 shows a cross section through a barrel pump with cylindrical lifting pipes.
Figure 14:
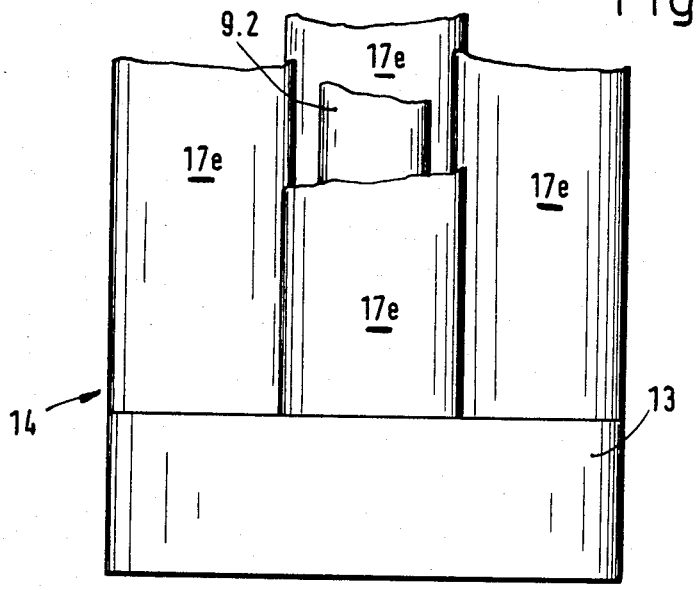
FIG. 14 shows a side view of the barrel pump according to FIG. 13.

FIGS. 13 and 14 show in diagrammatic form a lifting pipe set 14 which consists of four cylindrical lifting pipes **17*e*. The lifting pipes are disposed at equal distances from each other in the circumferential direction and their longitudinal axes are arranged in a circle which is concentric with the drive shaft 9.2. Like the lifting pipes 17*d* in FIG. 9, they likewise hold the lower guide bearing 10 of the shaft. The line contact of the lifting pipes with the guide bearing 10 and with upper bearings of the shaft (not shown) corresponds to the function of the support housing whereby clearance gaps 27 are formed which are open towards the space surrounding the pump. The drive shaft 9.2 is thus freely jacketed by pressureless fluid. The pipes 17*e* have the same diameter with the result that their radially outer surface lines lie on an imaginary cylinder which forms the outer limit of the lifting pipe set 14**.

The foregoing examples are set forth for the purpose of illustrating the present invention but are not deemed to limit the scope thereof. Clearly, numerous additional modifications could be made without departing from the scope of the invention as set forth in the appended claims.

What is claimed is:

1. A pump comprising:

an elongated support housing;

an elongated drive shaft surrounded by said housing, said drive shaft having an upper end and a lower end, and being mounted in said support housing by at least one lower bearing and one upper bearing, an annular space being formed between said lower bearing and said drive shaft;

a rotor mounted to said lower end of said drive shaft;

a rotor chamber disposed around said rotor, said rotor chamber having an upper portion bordering a lower part of said lower bearing;

at least one lifting duct having a lower end with an inlet in said rotor chamber, said lifting duct extending along said support housing in the direction of said shaft and having an upper end with an outlet;

a clearance gap formed in said support housing extending into said lifting duct, with walls separating said clearance gap from a flow of liquid in said lifting duct, said annular space opening into said clearance gap, said clearance gap having a greater cross sectional area than said annular space and being substantially free of pressure during pump operation; and an outlet passage connecting said clearance gap with space surrounding said pump to discharge liquid in said clearance gap, said outlet passage being disposed at a lower end of said housing above said rotor chamber.

2. A pump as set forth in claim 1 wherein said lifting duct at least partially surrounds said support housing, and said support housing includes an interior space, and wherein said clearance gap comprises an axial slit which penetrates said support housing.

3. A pump as set forth in claim 2 wherein said axial slit begins immediately above said rotor chamber.

4. A pump as set forth in claim 1 wherein said outlet passage comprises a penetration of said lifting pipe.

5. A pump as set forth in claim 2 wherein said axial slit extends substantially over the entire length of said lifting duct.

6. A pump as set forth in claim 1 wherein said outlet passage extends substantially over the entire length of said clearance gap.

7. A pump as set forth in claim 1 wherein a second clearance gap is formed in said support housing diametrically opposite to said first mentioned clearance gap.

8. A pump as set forth in claim 1 wherein said support housing is integral with said lifting duct.

9. A pump as set forth in claim 1 wherein said lifting duct at least partially surrounds said support housing and said support housing is form fitted into said lifting duct.

10. A pump as set forth in claim 1 wherein said lifting duct is metal and said support housing is plastic.

11. A pump as set forth in claim 1 including several clearance gaps formed in said support housing, said clearance gaps extending into said lifting duct to divide said lifting duct into sections which are uniformly distributed around said drive shaft.

12. A pump as set forth in claim 11 wherein said lifting duct comprises a plurality of separate pipes having neighboring walls bordering said clearance gaps.

13. A pump as set forth in claim 12 wherein said lifting pipes are segments disposed in a circular ring.

14. A pump as set forth in claim 1 wherein said clearance gap has an end facing said rotor chamber, said end being sealed by a plug having a surface inclined relative to said drive shaft which surface extends along said clearance gap to said outlet passage.

15. A pump as set forth in claim 1 wherein said shaft is supported by a plurality of bearings spaced along said shaft.

16. A pump as set forth in claim 1 wherein said lifting duct and said support housing coaxially surround said drive shaft.

* * * * *